United States Patent [19]

Baldi

[11] 4,141,760

[45] Feb. 27, 1979

[54] STAINLESS STEEL COATED WITH ALUMINUM

[75] Inventor: Alfonso L. Baldi, Drexel Hill, Pa.

[73] Assignee: Alloy Surfaces Company, Inc., Wilmington, Del.

[21] Appl. No.: 614,834

[22] Filed: Sep. 19, 1975

Related U.S. Application Data

[63] Continuation-in-part of Ser. No. 304,220, Nov. 6, 1972, Pat. No. 3,936,539, and Ser. No. 357,616, May 3, 1973, Pat. No. 3,948,687, and Ser. No. 404,665, Oct. 9, 1973, Pat. No. 3,948,689, and Ser. No. 446,473, Feb. 27, 1974, Pat. No. 3,958,046, and Ser. No. 466,908, May 3, 1974, Pat. No. 3,958,047, and Ser. No. 579,945, May 22, 1975, abandoned, said Ser. No. 304,220 is a continuation-in-part of Ser. No. 219,514, Jan. 20, 1972, Pat. No. 3,801,357, said Ser. No. 357,616 is a continuation-in-part of Ser. No. 90,682, Nov. 18, 1970, Pat. No. 3,764,371, said Ser. No. 404,665 is a continuation-in-part of Ser. No. 254,403, May 18, 1972, Pat. No. 3,785,854, said Ser. No. 90,682 and said Ser. No. 219,514 is a continuation-in-part of Ser. No. 837,811, June 30, 1969, both abandoned.

[51] Int. Cl.[2] ..... C23F 7/10; C23C 9/02

[52] U.S. Cl. ..... 148/31.5; 428/653; 148/6.16; 427/383 D; 427/192; 427/405

[58] Field of Search ..... 427/383 D, 383 C, 376 H, 427/192, 229, 205, 405; 148/6.16, 31.5; 428/653

[56] References Cited

U.S. PATENT DOCUMENTS

| | | | |
|---|---|---|---|
| 1,817,888 | 8/1931 | Lowe | 427/383 D |
| 3,041,206 | 6/1962 | Long et al. | 427/383 D |
| 3,248,251 | 4/1966 | Allen | 106/286 X |
| 3,318,716 | 5/1967 | Schuster et al. | 106/287 |
| 3,671,331 | 6/1972 | Malkin et al. | 148/6.2 |
| 3,687,738 | 8/1972 | Malkin | 148/6.2 |
| 3,717,509 | 2/1973 | Palm et al. | 148/6.2 |
| 3,769,068 | 10/1973 | Yamagishi et al. | 427/383 D |
| 3,787,305 | 1/1974 | Ballard | 204/181 |
| 3,891,784 | 6/1975 | Allardyce | 427/383 D |
| 3,949,122 | 4/1976 | Lepetit et al. | 427/253 |

FOREIGN PATENT DOCUMENTS

| | | | |
|---|---|---|---|
| 282652 | 12/1965 | Australia | 427/192 |
| 474064 | 1/1936 | United Kingdom | 427/192 |
| 1019202 | 2/1966 | United Kingdom | 148/6.3 |

*Primary Examiner*—Ralph S. Kendall
*Attorney, Agent, or Firm*—Connolly and Hutz

[57] ABSTRACT

Aluminum diffusion can be effected from continuous coatings of leafing-type aluminum particles and such leafing coatings in very thin layers are more effective than coatings of non-leafing aluminum, with or without diffusion. Other protective metals in flake or leaf form can be substituted for or added to the leafing aluminum. Adhesion of the flakes to the substrate is greatly improved and can be effected at lower temperatures if the flakes are applied from a dispersion containing a volatilizable halogen-type carrier or an ammonium chromate. The leafing coatings can be sprayed on from aqueous dispersion containing wetting agents and if desired a polyethylenetrtrafluoroethylene and/or mixtures of phosphoric acid, chromic acid and magnesium, aluminum, calcium or zinc salts of these acids. A protective second coating of such mixtures can be applied as a cover layer over the layer containing the leafing aluminum, and this combination works best on a ferrous metal that has an aluminum diffusion coating, particularly a ferrous metal that contains less than 1% chromium and has such an aluminum diffusion coating. It also works very well on aluminum diffusion coatings from packs containing chromium, or chromium and silicon, in addition to the aluminum, and these alloys can be made by magnesothermic reduction of their mixed oxides or the like. The aluminum diffusion can also be made from a pack containing cobalt with or without a little chromium, and this forms a particularly desirable diffusion coating on nickel-base alloys. Aluminum diffusion coatings can be kept from undesired locations by covering those locations with an $Ni_3Al$-type masking layer containing thermoplastic resin over which is applied a powdered nickel masking layer containing thermoplastic resin. On firing this masking combination forms a strong shell that effectively masks without contaminating the surrounding coating pack.

5 Claims, No Drawings

STAINLESS STEEL COATED WITH ALUMINUM

The present application is a continuation-in-part of application Ser. Nos. 304,220 filed Nov. 6, 1972 (U.S. Pat. No. 3,936,539 granted Feb. 3, 1976); 357,616 filed May 3, 1973 (U.S. Pat. No. 3,948,687 granted Apr. 6, 1976); 404,665 filed Oct. 9, 1973 (U.S. Pat. No. 3,948,689 granted Apr. 6, 1976); 446,473 filed Feb. 27, 1974 (U.S. Pat. No. 3,958,046 granted May 18, 1976); 466,908 filed May 3, 1974 (U.S. Pat. No. 3,958,047 granted May 18, 1976) and 579,945 filed May 22, 1975 and subsequently abandoned. The first four of this set of six prior applications are continuations-in-part of application Ser. No. 219,514 filed Jan. 20, 1972 (U.S. Pat. No. 3,801,357 granted Apr. 2, 1974); Ser. No. 90,682 filed Nov. 18, 1970 (U.S. Pat. No. 3,764,371 granted Oct. 9, 1973); and Ser. No. 254,403 filed May 18, 1972 (U.S. Pat. No. 3,785,854 granted Jan. 15, 1974). Application Ser. Nos. 90,682 and 219,514 are in turn continuations-in-part of application Ser. No. 837,811 filed June 30, 1969 and subsequently abandoned.

BACKGROUND OF THE INVENTION

This invention relates to the coating of metals to improve their use, particularly in resisting corrosion as well as attack by chemicals.

Among the objects of the present invention is the provision of novel coating methods and compositions, as well as novel coated metals, that are simple to manufacture and use and are highly effective.

SUMMARY OF THE INVENTION

The foregoing as well as additional objects of the present invention will be more fully understood from the following description of several of its exemplifications.

According to the present invention, flake forms of protective metals form particularly effective protective coatings for corrodible metals when partially diffused into the surface to be protected or when combined with special binders or added over other coatings.

As shown in U.S. Pat. Nos. 3,248,251 granted Apr. 25, 1966 and 3,787,305 granted Jan. 22, 1974, powdered aluminum has been suggested for use in applying protective layers over corrodible metals. The protection thus obtainable from layers of less than about 1 or 1.5 milligrams per square centimeter, is greatly improved if the aluminum coating is effectively continuous over the surface being protected, a result that is obtained when leafing-type aluminum particles are applied in amounts that permit the individual aluminum flakes to partially overlap each other over the entire surface being protected. It is also helpful, as suggested in U.S. Pat. No. 3,787,305, to subject the aluminum-coated ferrous member to a temperature that causes at least a little bit of the aluminum to diffuse into the ferrous surface.

Leafing type aluminum particles can be made as described in U.S. Pat. No. 2,312,088, and are generally characterized by the presence of stearic acid or aluminum stearate or the like as a very thin coating on the surface of each aluminum particle, a condition which makes it extremely difficult to disperse such aluminum particles in water. A substantial amount of wetting agent will effect a suitable dispersion, although it is easier to effect such dispersions by also adding diethylene glycol or triethylene glycol or more highly polymeric ethylene glycols having a molecular weight up to about 9000, as described in U.S. Pat. No. 3,318,716 granted May 9, 1967, or by adding glycerine. As shown in the last-mentioned patent, very effective dispersions of leafing-type aluminum can be made from a concentrate that consists essentially of the leafing aluminum, the polymeric ethylene glycol and a wetting agent, the aluminum being present in an amount about $\frac{1}{4}$ to about $1\frac{1}{2}$ parts by weight for every part of the polymeric ethylene glycol by weight, and the wetting agent concentration from about 5% to about 25% by weight of the concentrate.

The foregoing concentrate readily mixes with water in all proportions to provide an aqueous dispersion of almost any desired aluminum content. Thus a diluted dispersion containing 5% aluminum, 6% hexa-ethylene glycol and 0.7% para-n-octyl phenyl ether of decaethylene glycol, is readily sprayed onto a stator ring of a jet engine compressor to leave a coating weighing 0.5 milligram per square centimeter after drying in air to evaporate most of the water. The stator thus coated is then heated in an air oven until its temperature reaches 800° F. The heating first causes the glycol and wetting agent to be volatilized off leaving a very adherent, continuous and shiny coating that resembles polished aluminum and significantly adds to the corrosion resistance of the stator ring even if the heating temperature goes no higher than 600° F. The increase in corrosion resistance becomes more significant when the heating carries the coating to temperatures of about 900° F., where some diffusion of the aluminum into the ferrous surface of the stator begins. The rate of diffusion and the degree of resulting corrosion resistance is further increased by confining the coated stator in an atmosphere of gaseous aluminum chloride while it is at temperatures above about 700° F.

The aluminum chloride atmosphere is conveniently provided by a pack treatment as described in Example I of application Ser. No. 446,473 or Example I A (infra) of the present application, but with no aluminum in the pack. However the stator ring containing the leafing aluminum coating can merely be hung on a wire in a retort containing a little energizer and no pack, and fired in this way in an otherwise inert atmosphere.

Other aluminum halides such as aluminum bromide and aluminum iodide also behave like aluminum chloride and indeed other well known energizers for low temperature aluminum diffusion coatings can be used instead of the aluminum halides, with corresponding results. A list of such energizers is given in application Ser. No. 357,616.

Instead of adding the energizer to the atmosphere in which the heating is effected, it can be added to the dispersion from which the metal flake is applied. Thus the above-mentioned diluted dispersion of aluminum deposits on 410 stainless steel or on plain carbon steel an adherent 0.1 milligram per square centimeter coating, after heating in air to about 600° or 700° F. for as little as 20 seconds. Other ammonium halides and similar high temperature or low temperature aluminizing energizers that are driven off at 600° to 1000° F. can be used to give adherent protective films weighing as much as 4 milligrams per square centimeter when so heated. For this purpose the energizer content should be no greater than about 80%, and at least 1%, of the weight of the flaked metal. Larger quantities can be used but merely require more time and heat energy to be driven off. Some fluorides can cause significant attack of the aluminum or of the substrate, and are best avoided or used in a high speed operation in which the time they contact these metals is restricted to minimize the deleterious effects of such attack.

The adhesion of 0.1 to 4 milligrams per square centimeter layer of a flaked metal such as aluminum is also improved by incorporating in the layer chromic acid, or a compound such as ammonium chromate or dichromate which is a salt of chromic acid with a volatile base, or magnesium chromate or dichromate, or water-soluble chromates or dichromates of other divalent metals. Dissolving in the aluminum dispersion an amount of ammonium dichromate 2% by weight of the aluminum gives a sharp increase in adhesion upon heating of a dried 4 milligram per square centimeter layer of such composition on plain carbon steel to 700° F. for 5 minutes. A 5% addition of the dichromate to the dispersion renders such a heat-treated coating completely resistant to wiping off. Similar results are obtained when the heating is at 600° to 1000° F. for as little as 20 seconds, and as much as 20 to 30 minutes, although not much is gained by prolonging the heating beyond about 1 minute. The ammonium dichromate content can be as high as 80% of the weight of the metal, but above this level the corrosion resistance tends to drop off.

The dichromates are used in amounts corresponding to the foregoing amounts of ammonium dichromate, the chromates in amounts about one-fifth greater, and chromic acid in amounts about one-fifth less. Each of these chromium compounds improves the aluminum coating so that it provides good salt spray resistance to plain carbon steel on which such a coating is applied. When such coating is covered by any other corrosion-resisting top coating, such as those described in the working examples, exceptionally good corrosion resistance is imparted, even to plain carbon steels.

The leafing-type of aluminum particles or other protective metal used in the above connection are preferably from about 50 to about 250 microns in maximum size although other sizes can also be used.

Non-ionic wetting agents are preferred for dispersing the aluminum inasmuch as such wetting agents are more readily driven off by high temperatures. However other types of wetting agents, including those that are not driven off or not completely driven off at 600° to 900° F. or 1000° F., can be used. Making the aluminum coatings heavier than about 4 milligrams per square centimeter does not add anything significant to the corrosion resistance, and as little as 0.1 milligram per square centimeter is helpful although at least about 0.3 milligram per square centimeter, and better still 1 to 2 milligrams per square centimeter is preferred.

Inasmuch as ferrous metals, such as plain carbon steel, cast iron, low alloy steels, stainless steels and other chromium-containing steels begin to oxidize on their surface at the temperatures used for the heating of the flake layer, it is helpful but not essential to conduct that heating in a non-oxidizing atmosphere. When the energizer used in such heating step is incorporated in the layer of flaked metal, the volatilization of the energizer along with the volatilization of any suspending agent present in the dispersion from which the flaked metal deposits, provides an atmosphere of reduced oxidation potential, and heat treatments that only extend for half a minute or less need no further oxidation-preventing precautions. However, if desired, the heating can be effected in a closed chamber as by batch heating an opened coil of coated metal sheet or wire placed in the closed chamber which then has its atmosphere flushed out with argon, hydrogen or nitrogen, or by continuously passing a continuous strip or wire of the coated metal into and out of the chamber through close-fitting slots or holes in the chamber walls, while continuously introducing into the chamber a small stream of protective gas that makes up for losses of gas through the slots or holes.

When the metal flakes to be applied are aluminum, the benefits of a non-oxidizing atmosphere are not significant and an atmosphere of ambient air is entirely adequate.

It is not essential to have the polyglycol present in the flake dispersions in the foregoing proportions, or at all, although such presence is helpful. Reducing its concentration leaves less of it in the layer of metal flakes, so that less has to be driven off or converted to innocuous residue by the heating operation. Without the polyglycol, the dispersions require frequent agitation and then coatings applied by spraying from such dispersions tend to be of non-uniform thickness.

The application of a leafing-type aluminum coating particularly improves the corrosion resistance of plain carbon steel or other ferrous surfaces that contain less than 1% chromium, when such surfaces have a diffusion coating of aluminum. The adhesion promotion obtained with the energizer treatments described above is accompanied by a little diffusion of the aluminum into the substrate, and in addition the aluminum coatings thus formed are highly conductive to electricity as well as highly protective.

The leafing aluminum coating also improves the corrosion resistance of a coating obtained from mixtures of aluminum particles with phosphoric acid, chromic acid and magnesium, aluminum, calcium or zinc salts of these, as described in U.S. Pat. No. 3,248,251. Thus substituting the leafing aluminum, along with sufficient wetting agent and with or without the polymeric ethylene glycol, for the spherical aluminum in the formulations described in that patent contributes a significant increase in corrosion resistance, particularly in cured layers weighing not more than about 1 milligram per square centimeter. In such mixtures firing of an aluminum-containing coating does not effect significant diffusion of aluminum into a ferrous substrate so long as the firing temperature is not over 1000° F. Above that temperature the firing tends to adversely affect ferrous metals, particularly those used in jet engine compressor sections.

Another feature of the use of leafing-type aluminum is the improved appearance that the workpieces are given. Substituting this type of aluminum for that shown in the composition of Example I in U.S. Pat. No. 3,248,251 with the help of the foregoing polyglycol-wetting agent formulation, not only gives a product having somewhat better corrosion resistance, but with a bright aluminum sheen. During the heating of the new compositions to cure them, fumes are given off indicating that the polyglycol and the wetting agent are being volatilized away, and no significant reduction of the hexavalent chromium to trivalent condition seems to take place.

The foregoing improvements in corrosion resistance and in appearance are also obtained when the last-mentioned coating is covered by a similar coating, even one that does not contain metallic aluminum. Such top coatings are described in application Ser. No. 357,616 and Ser. No. 404,665, and the contents of those applications are hereby incorporated in the present application as though fully set out herein. However multiple coating layers each of which contains metallic aluminum are very effective, particularly when each layer weighs between 0.1 and 0.5 milligrams per square centimeter.

As shown in the aforementioned applications, the proportions of the ingredients in the chromic acid-phosphoric acid-salt coating mixture can range as follows:

| | | |
|---|---|---|
| Chromate ion | 0.2 to 1, | preferably 0.4 to 0.8 mols per liter |
| Phosphate ion | 0.7 to 4, | preferably 1.5 to 3.5 mols per liter |
| Magnesium ion | 0.4 to 1.7, | preferably 0.9 to 1.4 mols per liter |
| Polytetrafluoroethylene resin | 2 to 14, | preferably 3 to 10 grams per liter |

The magnesium ion can be replaced by any of the other ions referred to above, in the same concentrations.

Instead of directly applying such an overlying coating whether or not it contains metallic aluminum, it can be applied after an intervening coating of colloidal alumina or the like weighing about 0.1 to about 1 milligram per square centimeter, also as described in applications Ser. No. 357,616 and Ser. No. 404,665, with increases in corrosion resistance as described in those patent applications. With or without such an intervening coat, the final cured article has a golden sheen, contributed by the presence of chromate, that is extremely attractive and quite adherent. The presence of polytetrafluoroethylene particles in the phosphoric acid-chromic acid-salt mixtures of either or both of such layers is also helpful, as described in the last-mentioned applications, and does not detract from the golden appearance. Such presence in a top coating makes that coating very smooth and slippery without detracting significantly from the coating hardness. These coating combinations with or without the intervening coating of colloidal particles are most effective in increasing the corrosion resistance of chromium-free and chromium-containing ferrous substrates that have aluminum-diffused surfaces.

Indeed they also have this desirable effect on bulk aluminum such as aluminum sheets, foil and bars, as well as on titanium. On aluminum substrates such coatings adhere exceptionally well and withstand severe deformation of the surfaces to which they are applied. However the gold color contributed by the foregoing top coatings that are free of metallic aluminum, is not provided when metallic aluminum is included in those top coating formulations. The intervening coatings of colloidal alumina and the like are not heavy enough to obscure the metallic appearance of the substrate and accordingly do not adversely affect the appearance. On the other hand those intervening layers improve the wettability of the aluminum-containing surface by the top coating. Some alumina dispersions are acid and tend to attack a layer of aluminum on which they are applied. To alleviate this situation the alumina dispersion used can be neutral or even somewhat alkaline, or the acidity of such dispersion can be so low in strength and the dispersion so rapidly applied and dried that any attack is immaterial, or a little chromic acid is added to the dispersion to protect the aluminum.

The following are examples of the production of gold-colored highly attractive and very corrosion-resistant steel and aluminum products.

EXAMPLE I

A. Into each of four plain carbon steel retort cups 2 feet wide and 14 inches high is poured a powder pack consisting of 20% aluminum by weight and 80% alumina, both minus 325 mesh and uniformly mixed together. After the retort bottoms are covered with about one-half inch of powder, jet engine compressor blades made of AISI 410 stainless steel are laid over the powder layer, the blades being spaced about one-eight inch apart. This layer of blades is then covered with more powder till the powder is about one-half inch above the vane tops, and another layer of blades is then laid down and the layering repeated until the entire packing is 12½ inches deep in each retort. More pack powder is then added to each retort to assure there is about 1 inch of powder above the tops of the topmost blades, following which there is sprinkled over each a very thin stratum of crystalline $AlCl_3.6H_2O$ in an amount weighing 0.6% of the total powder weight. The retorts are then filled to their tops with additional pack powder, and they are stacked one above the other on the floor of a gas-fired bell furnace. The stacking does not seal any of the retorts shut. The top of the furnace equipped with gas inlet and outlet flush lines is lowered over the stack and sealed against the furnace floor, and a slow flow of argon gas is passed through the furnace interior to start flushing out the air within it. After the argon purge hydrogen is substituted for the argon, and is introduced at a rate that permits it to be burned with a small flame as it emerges from the end of the outlet tube. Only a very low flow rate is necessary, about 10 to 15 standard cubic feet per hour.

The heating of the furnace is started at a rate of about 1.5° F. per minute, as measured by thermocouples in each retort and connected to external meters, and when the thermocouples reach 300° F. the flow of hydrogen can be reduced so that the outlet flame is very tiny. At this point the hydrogen inflow can be less than 10 standard cubic feet per hour.

As the heating-up continues, the temperatures indicated by the thermocouples increase uniformly and gradually and chemical vapors begin to appear in the burning outlet gas. By the time the thermocouple temperatures reach about 450° F. the discharge of chemical vapors has subsided, the gas flow continuing till the temperatures reach 875° F. where the furnace heating is set to hold.

After 16 hours at 875° F. the furnace heating is terminated and the furnace permitted to cool until the thermocouple temperatures reach 300° F. The atmosphere in the furnace is then purged by switching the inflow gas to argon or nitrogen and the furnace shell then removed from the retorts, permitting the retorts to cool further in air. The contents of the retorts are then poured out, washed, dried and finally lightly blasted with fine glass particles propelled by an air stream supplied at 5 to 10 pounds per square inch, giving an aluminum pick-up of 4.0 milligrams per square centimeter of ferrous surface.

B. On the lightly blasted aluminized surface there is sprayed with an air-propelled spray, a uniform very thin layer from an aqueous dispersion of 3.5% $CrO_3$;
2.4% MgO;
11% $H_3PO_4$;
5.7% leafing aluminum;
6.8% polyethylene glycol having an average molecular weight of 300 and in which the glycols range from pentamethylene glycol through heptamethylene glycol; and 0.8% para-isononyl phenylether of dodecaethylene glycol;

all percentages being by weight.

The sprayed blades are then air dried and baked at 700° F. in an air oven for 30 minutes to give a coating weight from this spray of 0.7 milligram per square centimeter of ferrous surface.

C. The blades coated in steps A and B have their coated surfaces given a spray coating of colloidal alumina dispersed in a 20° concentration by weight in water to which a little HCl is added to bring the pH down to about 4. A very fine spray is used to leave a light coating which after drying in air weighs 0.5 milligram per square centimeter.

D. The blades with the air-dried coatings are then given a top spray coating from an aqueous dispersion of 5.8% $CrO_3$;

4% MgO;

18.3% $H_3PO_4$; and 0.5% polytetrafluoroethylene particles about 1 micron in size;

this spray being such that upon air drying in an oven and then baking at 700° F. for 30 minutes in an air oven, the final coating weights 0.5 milligram per square centimeter.

EXAMPLE II

The coating steps of Example I are repeated but this time the workpieces are SAE 1010 steel, the diffusion pack peak temperature is 800° F., the aluminum picked up in the diffusion step is 7½ milligrams per square centimeter, the baking in steps B and D is at 900° F., and the coat weight applied in step B is 0.9 milligram per square centimeter.

EXAMPLE III

Discs of low alloy steel containing 0.5% chromium and 0.02% carbon as the only significant alloy ingredients, which discs are used to hold jet engine compressor blades, are given the coating treatment of Example I, this time the diffusion coating pack being held at a peak temperature of 900° F., the aluminum picked up in the diffusion being about 8 milligrams per square centimeter; the coating step B is followed by a light blasting with very fine glass microspheres about 5 microns in diameter propelled by an air stream from a blast supplied at 5 pounds per square inch gauge, and care being taken to make sure that no significant amount of the leafing aluminum in this coating is removed during such blasting.

EXAMPLE IV

Sheets of 18-8 stainless steel are given the coating sequence of steps B, C and D of Example I except that the sheets with coating B are baked at 800° F. for 30 minutes and after such baking that coating weighs 1 milligram per square centimeter. Coating D is also baked at 800° F. for 30 minutes with its weight being 0.7 milligram per square centimeter.

EXAMPLE V

Plates of Type 3S aluminum were coated by the sequence of steps B, C and D of Example I, and the coated plates had a gold sheen of very attractive appearance.

EXAMPLE VI

Titanium sheets coated by the steps B, C and D of Example I were also colored with a golden sheen.

EXAMPLE VII

Coupons of 410 stainless steel are dipped in the coating mixture of Example I B, modified by the addition of 0.4% fine teflon particles from an aqueous teflon dispersion. The coupons were removed from the coating mixture and heated to volatilize off the wetting agents, taking care to remove the aqueous material running down to the lower edges of the coupons and to thus keep the coating more uniform in thickness. After the volatilization is completed the coupons are quenched in water and have a very smooth and slippery surface.

Essentially the same results are obtained in Example I as well as in Examples II and III when anhydrous aluminum chloride, bromide or iodide, or hydrated aluminum bromide or iodide is used in place of the hydrated chloride energizer, with the aluminum content of the pack ranging from 100% down to 2%. For aluminum diffusion effected below 900° F. it is preferred that at least 4% aluminum be in the pack. As disclosed in Ser. No. 304,220, a convenient amount of hydrated energizer is from 3 to 6 grams for a 6½ pound pack when the pack is first broken in as well as when the broken-in pack is subsequently used for coating.

Instead of using aluminum of relatively pure composition such aluminum can be an alloy containing significant quantities of beneficial ingredients such as silicon. A content of 12% silicon will, by way of example, improve the resistance to high temperature oxidation of ferrous metals subjected to diffusion coating by such an alloy.

The very effective protection imparted to ferrous metals containing less than 1% chromium, such as plain carbon and low alloy steels does not require more than a single layer of the chromic acid-phosphoric acid-salt-aluminum mixture, when preceded by an aluminum diffusion treatment. This is illustrated by the following examples.

EXAMPLE VIII

Panels of SAE 1010 steel are given the diffusion coating treatment of step A in Example I, but using anhydrous $AlCl_3$ energizer. The diffusion coating weighed 7 milligrams per square centimeter, and it was then coated by spraying on an aqueous dispersion containing the chromic-acid-phosphoric acid-salt aluminum mix in the following proportions:

1.25 moles per liter $PO_4^{----}$ 0.68 moles per liter $Mg^{++}$ 0.38 moles per liter $CrO_4^{--}$ 64.5 grams per liter Aluminum 77.0 grams per liter of the polyethylene glycol of Example II, and 10.0 grams per liter of para-isooctyl phenyl ether of tetradecaethylene glycol The sprayed-on layer was dried and heated in an air oven to 900° F. for 25 minutes to give a 1 milligram per square centimeter coating weight.

The thus-coated panel withstood 10 cycles of alternately heating to 900° F. for 6 hours in air followed by 16 hours exposure to a 5% salt-spray at 95° F. without showing attack of base metal, and substantially no attack nor spalling of the coating. Even better results are produced when the dried and oven-heated coating is covered by another layer preferably just like the sprayed-on layer but not containing the metallic aluminum. A porous alumina barrier between these two layers gives still further improvement.

Similar results are obtained when aluminum ions replace the magnesium ions, as well as when the baking is at 700° F. and the baked coating lightly blasted with very fine glass microspheres about 25 microns in diameter impelled by air blasted at a pressure of 5 pounds per square inch. Also the use of hydrated energizer during the diffusion coating produces the same results as the use of anhydrous energizer.

In the aluminum-containing coating mixtures the concentration of the leafing-type aluminum particles can range from about 30 to about 150 grams per liter of mixture, and the remaining ingredients can have the concentration ranges given supra. The water in these compositions can also be replaced in whole or in part by the polyethylene glycols or by any other inert liquid in which the ingredients can be dispersed and sprayed. For combinations in which only a single chromic acid-phosphoric acidsalt layer is used such layers can advantageously weigh as much as 1.5 milligrams per square centimeter. However even such a layer containing the leafing type aluminum of the present invention and weighing only 1 milligram per square centimeter or as much as two milligrams per square centimeter imparts excellent corrosion resistance to plain carbon and low alloy steels as well as other ferrous metals containing less than 1% chromium, when applied over an aluminum diffusion coating on the metal. This corrosion resistance is even further increased when the layer containing the leafing type aluminum has its electrical conductivity increased as by heating to 900° F. or higher; or by lightly blasting it with fine non-corroding particles such as glass or ground walnut shells or the like; or by heating it in the presence of ammonium chloride or other energizers as described above.

Thus panels of steel containing 0.05% carbon and 0.3% titanium as the only material alloying metal, show unusually high resistance to salt spray corrosion when covered by an aluminum diffusion coat having an aluminum pick-up of 6.5 milligrams per square centimeter, over which is applied the phosphoric acid-chromic acid-salt-aluminum coating of Example VIII but baked at 700° F. and then given a light blasting with fine glass microspheres in a 5 psi air stream, the blasting removing about 0.1 milligram of the baked coating per square centimeter.

Although the thus protected panels show splendid corrosion resistance, their coated surfaces tend to turn white or grey after long exposure to salt spray, indicating that the aluminum in the top layer is being attached very slowly. This whitening or greying can proceed for a considerable time before the steel is attached, even where the coating is scratched through to the base metal. However the whitening or greying can be greatly slowed by covering the phosphoric acid-chromic acid-salt-aluminum layer with a top coating such as the combination of an air-dried colloidal alumina layer weighing 0.1 to 1 milligram per square centimeter and an overlying baked phosphoric acid-chromic acid-salt-teflon layer, weighing 0.2 to 1 milligram per square centimeter. It is preferred that the combination of layers on the aluminum diffused surface weigh not more than about 2 milligrams per square centimeter.

As pointed out above, the coatings containing the leafing type of aluminum in accordance with the present invention are electrically conductive to an appreciable degree when they have been subjected to baking of at least 900° F. or when they have been burnished as by means of the fine glass blasting, or when they are heated to at least about 600° F. in the presence of an energizer or an ammonium chromate or chromic acid. The greater their electrical conductivity, the greater the corrosion resistance they impart, particularly to ferrous substrates. These coatings are also smoother and more effective in thinner layers than comparable coatings containing granular aluminum as described in U.S. Pat. Nos. 3,248,251 and 3,787,305, and thus much more suitable for use on airfoils, particularly of turbines.

A silver flake coating adheres well to ferrous metal when heated to 600° to 700° F. in the absence of energizers. Indeed the application of energizers to silver flake coatings detracts from their effectiveness. On the other hand tin flake does not disperse very well and tin flake coatings are best heated to 900° F. or higher, without energizers.

Although Patent 3,248,251 suggests coatings as thin as 0.5 mil, the commercial coating formulation derived from it is marketed with instructions to apply it in thicknesses of at least 1.5 mil. Those instructions also suggest that those coatings be glass blasted and/or baked to 1000° F. or higher for best results. However superior results with the 3,248,251 coatings are obtained when there is applied over such coatings a very thin layer of flake aluminum. Thus a 410 stainless steel jet engine compressor blade coated with a 2 mil thick layer of the oven-dried (550° F.) commercial mixture containing granular aluminum and corresponding to Example 2 of U.S. Pat. No. 3,248,251, gave much better protection after there was sprayed over the oven-dried coating a 0.4 milligram per square centimeter layer of flake aluminum from a 2% suspension in an aqueous solution of only 2.4% hepta-ethylene glycol and 1/3% p-nonylphenoxy octadecaethoxy ethanol, and the thus-coated blade again baked dry at 550° or 600° F. The degree of improvement thus contributed by the additional flaking aluminum layer is approximately the same as that obtained by baking at 600° F. without that additional layer and then glass-blasting the first coating layer.

Continuous aluminum coatings as thin as 0.1 milligrams per square centimeter, and even thinner, are particularly desirable for coating titanium rivets used in aircrafts or spacecraft or similar equipment. In such combinations, the aluminum is conveniently applied in the form of flakes, as indicated above, and the adhesion of the flakes is improved by the diffusion type heat treatment with or without an energizer, or by incorporating an ammonium chromate with the aluminum flakes and heating to produce the bonding action described above.

Other protective metals in flake or leafing form can be used in place of or in addition to the flake aluminum to also increase the resistance of corrodible metals to oxidation and the like, particularly at high temperatures. Examples of such protective leafing metals are nickel, tin, stainless steels of all kinds, and silver. U.S. Pat. No. 3,709,439 describes the making of such flakes. Chromium-bearing or austenitic stainless steels are especially effective. Indeed flake type 304 or type 316 stainless steel when mixed with from about half to about twice its weight of flake aluminum, gives better protection against alkaline attack than flake aluminum alone. Alloys of nickel and aluminum such as NiAl, and alloys of iron or silicon with aluminum are also suitable for use in flake form in place of the aluminum flake to provide improved protection in accordance with the present invention. Mixtures of flaked metals can be applied as coating, and heated to cause the mixed metals to alloy with each other as well as with the substrate, and NiAl is readily formed in this way to make a very effective high-temperature-resistant coating.

While the dispersions containing flaked metal, with or without the chromate, phosphate and salts, can be applied by dipping, they are preferably applied by spraying or roller coating. In general such flake-metal-containing coatings should be baked at a temperature of at least 550° F. for a few minutes, and preferably for at least 30 minutes at as high a temperature as the coated combination will withstand, to provide best results. Alloying of the metals in the coating with each other and with the metal substrate is also desirably effected in the manner described in U.S. Pat. No. 3,720,537. Aluminized or tin coated plain carbon steel as well as steel coated with a mixture of aluminum and tin is conveniently made in this way, as by spraying sheet steel unwinding from a coil, with a dispersion of the flaked metal, then passing the thus coated metal sheet through gas flames to heat it to 700°–750° F. for 30 seconds, after which the sheet is cooled and recoiled.

Dispersions of flake metal, such as aluminum, also containing polytetrafluoroethylene, deposit coatings that are not only very decorative by reason of the metallic sheen, but they are also quite hydrophobic and smooth and especially low in frictional resistance to sliding with respect to other objects. Such coatings are also quite adherent to plain carbon steel or stainless steel or aluminum or aluminized substrates, even when cured at temperatures as low as 500° F. or barely sufficient to drive off the dispersing and suspending agents. Top coatings of the foregoing chromate-phosphate-salt mixtures or other conversion coatings can be applied over such a metal-tetrafluoroethylene initial coating. For best resistance to corrosion the teflon content should be held down to not over about 1% of the final coating, about 0.5% being particularly effective. Where the teflon-containing coating is heated to about 900° F. or higher the teflon content can before heating be as high as about 2% without detracting too much from the corrosion resistance.

The foregoing top coatings of chromic acid-phosphoric acid-salt formulations are also helpful when applied over aluminum diffusion coatings that are produced by the inhibited diffusion processes described in U.S. Pat. Nos. 3,257,230, 3,690,934, and 3,867,184. Those processes are generally conducted at temperatures well above 1100° F. with cobalt- and nickel-based superalloys, but can also be conducted with ferrous substrates at lower temperatures, particularly to diffuse less aluminum.

In such inhibited diffusion it is desirable to use extremely fine particles of pre-fired alloys such as alloys of aluminum and chromium, or of aluminum, chromium and silicon. Particle sizes of from about 1 to about 10 microns are particularly suitable.

The separate step of pre-firing the chromium and aluminum mixture can be avoided by directly preparing such a mixture in finely divided form. To this end the magnesothermic reduction of chromium compounds such as $Cr_2O_3$ as described in French Pat. No. 1,123,326 and its Addition Pat. No. 70,936, can be modified by combining an appropriate quantity of aluminum with the chromium compound, and such combination mixed and subjected to the magnesothermic reduction as described in those patents. This simultaneous reduction takes place at about the same temperatures and times as is shown for the reduction of the chromium compound alone and with the same equipment, producing a chromium-aluminum alloy having a particle size of about 1 micron. Residual magnesium as well as magnesium oxides present in the reduced material is removed by treatment with an excess of dilute nitric acid having a specific gravity of about 1.12 to about 1.26. Such acid will not attack chromium-aluminum alloys having as little as 16% chromium by weight, but will readily dissolve metallic magnesium as well as magnesium oxide. Crushing the alloy to a fine powder helps the acid dissolve all the magnesium rapidly. It is not essential to remove any magnesium oxide present in the reduced mixture inasmuch as this compound is essentially inert during a coating operation and does not tend to sinter or adhere to the workpieces being coated or to the other ingredients of the coating pack. Where the hot magnesothermic reaction mixture has its vapor flushed out at high temperatures to flush out the relatively volatile magnesium metal remaining after the reduction is completed, the crude reaction product can after crushing be directly used for diffusion coating. Where nitric acid washing is carried out, the washed material is rinsed with water, preferably to neutrality, filtered and dried before use.

Magnesothermic reduction can also be used in the same way to directly produce chromium-silicon, chromium-aluminum-silicon, chromium-aluminum-iron, molybdenum-silicon and tungsten-silicon alloys in the extremely finely divided form so highly desirable for diffusion coating workpieces. Silica makes a convenient source of silicon for such purposes and can be directly substituted for or added to the mixture being reduced without materially changing the reduction rate or temperature. The finely divided alloys can also be produced by magnesothermically reducing chromium, iron, molybdenum or tungsten oxides or other compounds of these metals in the presence of aluminum and/or silicon in elemental form. During such reduction the aluminum and/or silicon alloys with the metallic chromium, iron, molybdenum and tungsten as it is formed.

The following is an example of the dual reduction technique:

EXAMPLE IX 1392 grams of magnesium metal were placed in a plain carbon steel retort cup 8 inches in diameter and 7 inches deep, the retort uncovered with an inverted outer inconel retort and the combination heated in a furnace under an argon atmosphere to 1700° F. where it was held for 25 minutes to melt the magnesium. The molten metal was then permitted to cool, still under argon, to room temperature, when the covering retort was removed, and replaced after 104 grams powdered $Al_2O_3$ and 500 grams powdered $Cr_2O_3$ were poured over the solidified magnesium. The combination was again heated under argon, this time to 1825° F. for 8 hours, and cooled.

A powdery reaction product remained in the retort. It was removed from the retort, treated with excess 2 N $HNO_3$ until there was no further reaction evident, and then washed to neutrality with water. The resulting material was a chromium-aluminum intermetallic in the form of particles averaging about 1 micron in size. It analyzed 81.2% chromium and 16.6% aluminum by weight, its yield being 91%. When mixed with alumina and ammonium chloride it gave very good aluminum diffusion coatings in the process of Canadian Pat. No.

806,618, in place of the mixture of chromium and aluminum there suggested.

Similar results are obtained when the preliminary melting of the magnesium is not effected, and where the intermetallic is used for diffusion coating steels at lower temperatures. Other intermetallics similarly made and used have the following analyses:

(a) 45.5% Al
54.5% Cr
(b) 44.1% Cr
47.7% Fe
8.5% Al
(c) 74.5% Cr
7.0% Al
8.5% Si

Alloy (c) contains some unreduced oxide, but it still is very effective for use in the inhibited diffusion process.

Another type of aluminum diffusion coating over which the top coatings described above can be applied, is a pack diffusion aluminizing in which the aluminizing is inhibited by cobalt. This diffusion coating is illustrated by the following example:

EXAMPLE X

A pack was made up in parts by weight of

| | |
|---|---|
| cobalt | 30 |
| aluminum | 14 |
| alumina (calcined) | 56 |
| $NH_4Cl$ | ½ |

Each of the foregoing ingredients was a 250 to 360 mesh powder. The mixture was thoroughly blended and then packed in a plain carbon steel retort along with nickel blow tips used for blowing incandescent light bulbs as described in Ser. No. 579,945. The retort thus loaded was loosely covered and a larger retort lowered over it as illustrated in U.S. Pat. No. 3,764,371. Using a hydrogen-bathed atmosphere between the retorts, as also described in 3,764,371, the packed material was heated to 1975° F. where it was maintained for 20 hours. After cooling the treated workpieces and lightly glass-blasting them, all showed an aluminized case from about 4 to about 6 mils thick.

When the same treatment is applied to U-700 nickel base blades for the hot section of a jet engine, somewhat thinner diffusion coating cases are produced. While leafing aluminum coatings can be applied over the foregoing diffusion aluminized blades, even without such top coating the aluminized blades show exceptional resistance to oxidation and sulfidation. In general the resistance to these effects of the U-700 alloy blades is a little better than the resistance of such blades aluminized in a chromium-inhibited diffusion coating pack. This improvement seems to be due to the introduction of some cobalt into the case from the pack, and is not shown by the cobalt-base substrates. Other nickel-based superalloys such as B-1900, Renè 62, MAR-M 200 do show this improved resistance when so coated.

Nickel can also be used for inhibiting aluminum diffusion as for example into chromized dispersion-strengthened nickel in the manner described in U.S. Pat. No. 3,785,854, and will then make a product of outstanding oxidation resistance, particularly with a little chromium also present in the pack. A very suitable aluminum pack in which a large amount of nickel and a small amount of chromium lowers the diffusion effectiveness is disclosed by M. S. Seltzer, B. A. Wilcox and J. Stringer in Metallurgical Transactions, September 1972, pages 2391–2401. The Seltzer et al pack (600 g. alumina 82 g. Ni, 17 g. Al, 10.5 g. Cr, 6 g. NaCl and 6 g. urea) at 2210° F. for 32 hours in a hydrogen or argon-washed atmosphere deposits on chromized dispersion-strengthened nickel an aluminized layer having an aluminum pick-up of approximately 4 milligrams per square centimeter, a surface aluminum content of only about 4 to about 6%, and a case depth of about 4 mils. This product withstands about 190 hours of thermal cycling at 2500° F.

Instead of applying the Seltzer et al pack treatment directly to a chromized dispersion-strengthened nickel, it can be more effectively applied to a chromized dispersion-strengthened nickel that is first given an uninhibited aluminizing with a pick-up of 1.5 to 4 milligrams of aluminum per square centimeters, and the resulting aluminum-containing surface layer stripped off in accordance with U.S. Pat. No. 3,622,391. The resulting re-aluminized material shows no failure after 190 hours of thermal cycling at 2200° F., and about one-seventh the weight loss of the comparable product produced without the intervening aluminizing and stripping.

The ingredients of the Seltzer et al aluminizing pack can be varied plus or minus 20% from the amounts given above without significantly detracting from its effectiveness. The metallic ingredients of the pack do not have to be pre-alloyed, but the pack should be given a break-in heat treatment prior to use.

In connection with Example X, the cobalt and aluminum atom proportions can vary from about 0.4:1 to about 1:0.9 to obtain the advantages of that example; outside these ranges the case thicknesses produced are substantially smaller and not as desirable. Best results seem to be provided in the Co:Al range 0.8:1 to 1:0.9. The addition to the pack of about 0.1 atom chromium for every atom of aluminum increases the case thicknesses that are produced and increasing the chromium content to about 0.5 atom for every atom of aluminum further increases the thicknesses. The addition of the chromium also reduces the amount of oxide inclusion otherwise found in the aluminized cases, but those inclusions are not particularly harmful even when in the amounts formed in the absence of chromium.

The foregoing results with the Co-Al pack compositions are obtained when these two metals are the only ingredients of the pack, as well as when they are diluted with alumina, kaolin or other inert diluent to the point that the diluent is 90% of the pack. Also the $NH_4Cl$ can be replaced with any other energizer such as $NH_4Br$, $NH_4I$, $NH_4HF_2$, $I_2$ and the like, and the coating temperature varied from 1100° F. to about 2200° F. The atmosphere in the pack can be bathed with argon or other inert gas instead of nitrogen, or can be unbathed as by using a so-called glass sealed retort as described in U.S. Pat. No. 3,010,856 granted November 28, 1961.

Moreover these Co-Al packs produce very high quality diffusion coatings without requiring a preliminary break-in heat. They are accordingly simpler to prepare and use.

A feature of the present invention is that the flake or leafing aluminum or other metal forms coatings in which the individual metal flakes overlap each other so that the coatings are of continuous character with fewer skips or holes. This improves the protective action of the coatings. Even without such a flake metal overcoat the diffusion coatings from a Co-Al coating pack either containing or free of chromium, are very effective to protect iron, stainless steel, nickel and brass as well as bronze members that are used to shape molten glass, as described in Ser. No. 579,945. DV Minox bronze having the following composition in an example of such a metal that is well protected by such treatments:

| | |
|---|---|
| Copper | 63.5 - 68.5% |
| Nickel | 15.5 - 17.5% |
| Zinc | 8 - 10 % |
| Aluminum | 6.5 - 8.5% |
| Iron | 1.0% maximum |
| Lead plus Tin | 0.1% maximum |

This same alloy is also very well protected by pack aluminizing at 800°-900° F. for 20 hours in a simple diffusion coating pack such as described in the above-mentioned U.S. Pat. Nos. 3,764,373 or 3,785,854. Diffusion coating cases about 4 mils thick are thus obtained and make excellent protective coatings for incandescent lamp glass-blowing molds made from this alloy.

While so-called conversion coatings make very effective top coatings over the metal-containing coatings of the present invention (see Ser. No. 357,616), a particularly desirable conversion coating for use at temperatures of about 450° F. or below, is of the chromate-fluoride-iron-cyanide type. This is illustrated by the following examples.

EXAMPLE XI

Jet engine compressor blades of 410 stainless steel were aluminized as described in Example I A, and were then conversion coated by dipping in a bath of

| | |
|---|---|
| 5.6 grams | $CrO_3$ |
| 1.3 grams | $NH_4HF_2$ |
| 6.7 grams | $K_3Fe(CN)_6$ |
| 1.2 grams | $H_3BO_3$ |
| diluted to one liter. | |

The bath was kept at 80° F., and after one minute the dipped blades were withdrawn from the bath and rinsed in tap water. The resulting blades have improved lives when kept from heating up above 450° F., as compared to the same blades without the conversion coating.

The boric acid doesn't add much to the foregoing bath and can be omitted without materially reducing its effectiveness. The ferricyanide and bifluoride can have different alkali metals as cations and the bifluoride can be replaced by fluoride without noticeable changes in results. In general the $CrO_3$ content can range from about 0.01 to about 0.5 mols per liter, the fluoride ion between about 0.005 and about 0.2 mols per liter and the ferricyanide also between about 0.005 and about 0.2 mols per liter. Best results with boric acid has the borate ion in a concentration from about 0.005 and about 0.1 mols per liter. The bath temperature can vary from about 40° F. to its boiling point at atmospheric pressure.

The leafing aluminum or other leafing metal of the coatings of the present invention are generally applied in such small thicknesses that they do not significantly change the dimensions of the substrate being coated. Even where dimensional accuracy is of very close tolerance, as in the roots and buttresses of jet engine blades and vanes, such coatings can be applied over the entire substrate in the form of coatings 0.1 mil thick or thinner. Close tolerances will generally first require masking of the substrate to keep the diffusion coating from deposition inasmuch as diffusion coatings generally add about 0.3 mil to the dimensions of the material coated. Suitable masking techniques are described in U.S. Pat. No. 3,801,357, but a preferred technique is exemplified as follows:

EXAMPLE XII

A set of uncoated jet engine blades in IN-100 alloy was cleaned and their roots immersed in a stirred slurry of 100 g powdered masking mix in a solution of 3 g. poly(ethylmethacrylate) resin in 100 g. chloroform. The masking mix was $Ni_3Al$ containing 2% Cr, this combination then being diluted with an equal weight of alumina. The dipped blades were removed from the suspension and air-dried for five minutes. The resulting blades had their roots coated with a layer ranging from about 300 to 800 milligrams per square centimeter of masking powder and resin.

The blades with the dried coating were then dipped for a few seconds in a 50% weight dispersion of powdered nickel in the same resin solution. After withdrawing the blades were again air-dried, and both coatings weighed from about 500 to about 1200 milligrams per square centimeter. They were then packed in a prefired diffusion aluminizing pack having the following composition in parts by weight:

| | |
|---|---|
| Al (minus 325 mesh) | 10 |
| Cr (about 10 micron particle size) | 40 |
| $Al_2O_3$ | 50 |
| $NH_4Cl$ | 0.3 |

into which additional $NH_4Cl$ was blended to bring its concentration to the designated value. The packed assembly was heated in a retort as in Example I A to 1900° F. where it was kept for 5 hours. Upon cooling down and opening the retort, the aluminizing pack could be sucked out to the point that the blades could then be individually pulled out from the pack. The blades carried a hard shell of the originally applied masking layers that appeared sintered in place and did not readily crumble. It was a simple matter to remove all the blades from the pack along with all the masking mixture, leaving the remainder of the pack reusable without further separation.

The hard shell of masking mix could be broken off with an easy hammer blow and the cleanly masked blades thus recovered without damaging or even endangering them. Combined masking coatings which together weighed only about 300 to 200 milligrams per square centimeter were satisfactory for this purpose. Any of the other masking aluminide compositions of U.S. Pat. No. 3,801,357 can be used in the first masking layer in place of the $Ni_3Al$ to make the hard shell of the present invention.

On the other hand when using gum tragacanth or bentonite and only one masking layer, as described in U.S. Pat. No. 3,801,357, the high temperatures generally cause such layer to crack so that good masking is not obtained unless the masking coating weighs about 5 or more grams per square centimeter. Moreover such cracked coatings also disintegrate readily upon removal of the workpieces from the pack, and crumbled pieces of the masking layer wind up in the recovered pack. Such pieces must be arduously separated or the entire pack scrapped.

Other acrylic resins such as poly(ethylethacrylate), poly(methylacrylate), poly(butylacrylate), poly(acrylic acid), and other thermoplastic resins such as carboxy methyl cellulose, cellulose nitrate, ethyl cellulose, and even polyethylene, polypropylene, polystyrene and poly(vinyl chloride) can be used in place of the poly(ethylmethacrylate) but with results that are not as good. Readily volatilizable solvents such as those boiling below 100° C. are preferred as solvents for the resin.

Obviously many modifications and variations of the present invention are possible in the light of the above teachings. It is, therefore, to be understood that within the scope of the appended claims the invention may be practiced otherwise than as specifically described.

What is claimed:

1. In the combination of a corrodible stainless steel member having a diffusion-aluminized surface, the improvement according to which the protective coating is covered with a separate continuous adherent layer of aluminum in flake form.

2. The combination of claim 1 in which the corrodible member is a jet engine intake component.

3. The combination of claim 1 in which the separate layer is adhered with magnesium chromate and weighs not more than about 1 milligram per square centimeter.

4. The combination of claim 3 in which the separate layer is adhered with a mixture of chromic acid, phosphoric acid and their magnesium salts.

5. In a metal member having a surface coated with a cured mixture of finely-divided aluminum, phosphoric acid, chromic acid, and the magnesium salts of these acids, which mixture protects the surface against corrosion, the improvement according to which the metal surface is a diffusion-aluminized surface of AISI 410 stainless steel jet engine intake member, the finely-divided aluminum is aluminum leaf that forms a substantially continuous layer over said surface, and the cured coating weighs not more than about 1.5 milligrams per square centimeter.

* * * * *

UNITED STATES PATENT AND TRADEMARK OFFICE

CERTIFICATE OF CORRECTION

PATENT NO. : 4,141,760
DATED : FEBRUARY 27, 1979
INVENTOR(S) : ALFONSO L. BALDI

It is certified that error appears in the above-identified patent and that said Letters Patent are hereby corrected as shown below:

Col. 2, lines 49-66 should read as follows:
--Ser. No. 357,616. Some fluorides can cause significant attack of the alumi- --.

Col. 7, line 10, "20°" should be --2%--.

Col. 8, line 49, "$PO_4^{----}$" should be --$PO_4^{---}$ --.

Col. 9, line 49, "attached" should be --attacked--.

Col. 9, line 51, "attached" should be --attacked--.

Col. 10, line 15, "900°F" should be --400°F--.

Col. 15, line 3, "in" should be --is--.

Col. 16, line 5, "in" should be --of--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*